US012449223B1

(12) United States Patent
Calhoun

(10) Patent No.: US 12,449,223 B1
(45) Date of Patent: Oct. 21, 2025

(54) FIREARM RECOIL ATTENUATING DEVICES

(71) Applicant: Billy L. Calhoun, Oak Grove, LA (US)

(72) Inventor: Billy L. Calhoun, Oak Grove, LA (US)

( * ) Notice: Subject to any disclaimer, the term of this patent is extended or adjusted under 35 U.S.C. 154(b) by 0 days.

(21) Appl. No.: 19/036,217

(22) Filed: Jan. 24, 2025

(51) Int. Cl.
*F41A 23/16* (2006.01)

(52) U.S. Cl.
CPC ..... *F41A 23/16* (2013.01)

(58) Field of Classification Search
CPC ..... F41A 23/02; F41A 23/16; F41A 23/18; F41A 25/00; F41C 33/001
USPC ..... 42/94
See application file for complete search history.

(56) References Cited

U.S. PATENT DOCUMENTS 3,935,657 A * 2/1976 Wade ..... F41A 23/00 42/94
5,233,779 A * 8/1993 Shaw ..... F41A 23/02 42/94
5,332,185 A * 7/1994 Walker, III ..... F41A 23/02 248/910
5,758,447 A * 6/1998 Venetz ..... F41A 23/02 42/97
5,811,720 A * 9/1998 Quinnell ..... F41A 23/16 89/37.04
5,875,580 A * 3/1999 Hill ..... F41A 23/02 42/94
6,149,555 A 11/2000 Kinback
6,378,235 B1 * 4/2002 Smith ..... F41A 23/02 42/94
7,823,318 B2 * 11/2010 Hall ..... F41C 33/001 42/94
7,866,081 B2 1/2011 Seuk
8,011,129 B2 9/2011 Cauley et al.
8,096,077 B1 1/2012 Caywood
8,245,431 B2 8/2012 Werner
8,245,432 B2 8/2012 Letson
8,276,351 B1 10/2012 Henkin
8,286,381 B2 10/2012 Seuk
8,516,733 B1 * 8/2013 Richey, Jr. ..... F41C 23/16 42/94
9,964,254 B1 * 5/2018 Hayes ..... F41A 23/16
10,048,034 B1 * 8/2018 Reasor ..... F41A 23/16
10,323,898 B1 * 6/2019 Phillips ..... F41A 23/16
D873,944 S * 1/2020 Badgett ..... D22/199
10,670,365 B2 * 6/2020 Coleman ..... F41C 27/22
D901,873 S * 11/2020 Hughes ..... D3/201
10,852,092 B1 * 12/2020 Lindsay ..... F41A 23/12
10,890,406 B1 * 1/2021 Whang ..... F41C 33/001
D1,077,968 S * 6/2025 Fuller ..... D22/199
2008/0034636 A1 * 2/2008 Potterfield ..... F41A 23/04 42/94
2008/0263928 A1 * 10/2008 Potterfield ..... F41A 23/16 42/94

(Continued)

*Primary Examiner* — Joshua E Freeman
(74) *Attorney, Agent, or Firm* — R. Keith Harrison

(57) ABSTRACT

Firearm recoil attenuating devices may include a firearm support base having a base interior; a filler material in the base interior of the firearm support base, the filler material having a recoil-absorbing portion; and a recoil attenuating strap carried by the firearm support base proximate the recoil-absorbing portion of the filler material, the recoil attenuating strap configured for attachment to the firearm to transmit the recoil force from the firearm to the recoil-absorbing portion of the filler material upon firing of the firearm.

20 Claims, 8 Drawing Sheets

(56) References Cited

U.S. PATENT DOCUMENTS

| | | | | |
|---|---|---|---|---|
| 2009/0049731 | A1* | 2/2009 | Seuk | F41A 23/16 42/94 |
| 2012/0011759 | A1 | 1/2012 | Cauley et al. | |
| 2012/0246991 | A1* | 10/2012 | Seuk | F41C 33/001 42/94 |
| 2012/0285062 | A1 | 11/2012 | Cama | |

* cited by examiner

FIREARM RECOIL ATTENUATING DEVICES

FIELD

Illustrative embodiments of the disclosure generally relate to firearms. More particularly, illustrative embodiments of the disclosure relate to firearm recoil attenuating devices which support and anchor a firearm to absorb and attenuate a recoil force from the firearm as it is fired.

SUMMARY

Illustrative embodiments of the disclosure are generally directed to firearm recoil attenuating devices for attenuating a recoil force from a firearm. An illustrative embodiment of the firearm recoil attenuating devices may include a firearm support base having a base interior; a filler material in the base interior of the firearm support base, the filler material having a recoil-absorbing portion; and a recoil attenuating strap carried by the firearm support base proximate the recoil-absorbing portion of the filler material, the recoil attenuating strap configured for attachment to the firearm to transmit the recoil force from the firearm to the recoil-absorbing portion of the filler material upon firing of the firearm.

BRIEF DESCRIPTION OF THE DRAWINGS

Illustrative embodiments of the disclosure will now be described, by way of example, with reference to the accompanying drawings, in which.

DETAILED DESCRIPTION

Figure 1:
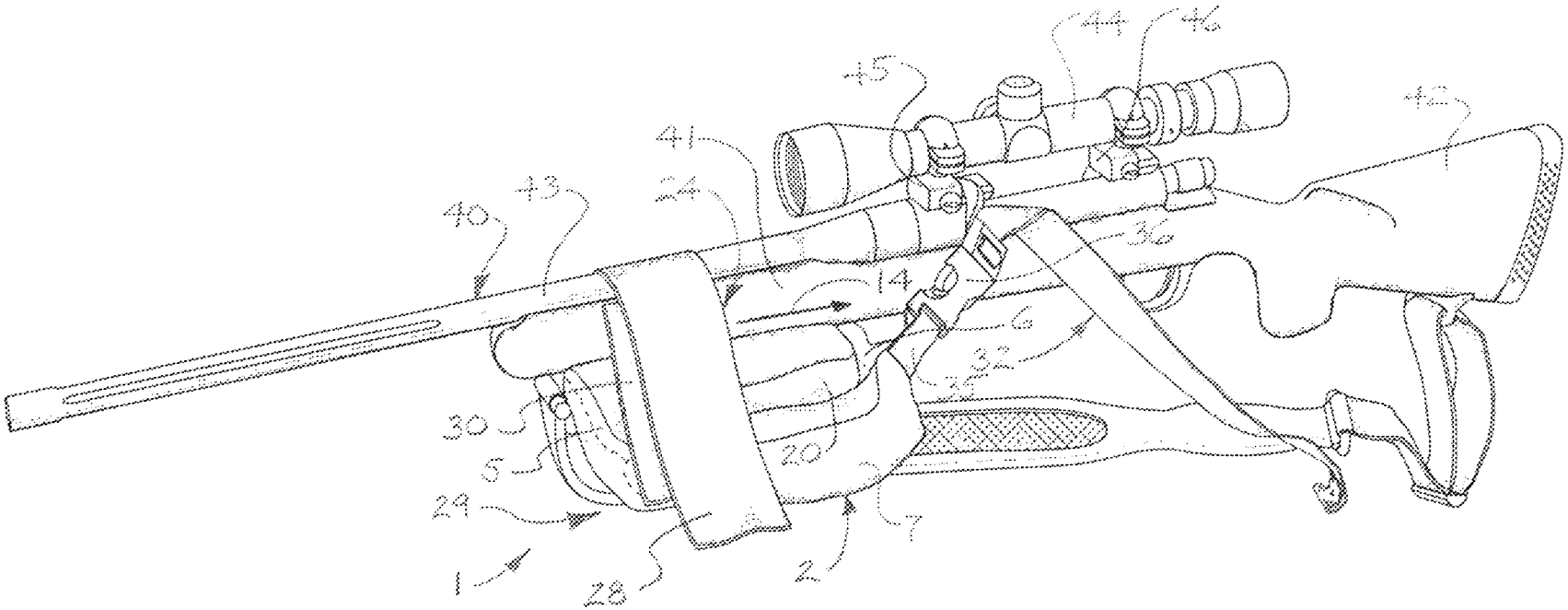
FIG. 1 is a perspective view of an illustrative embodiment of the firearm recoil attenuating devices, with a firearm anchored to the device in typical application of the device.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the subject matter as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

All methods set forth in the present disclosure may be performed in any suitable order of steps unless otherwise indicated herein or contradicted by the rules of logic. The use of any and all examples or exemplary language provided herein is intended to clearly describe the subject matter of the disclosure and is not intended to be limiting on the scope of the subject matter set forth in the claims. No element, step, ingredient, or limitation mentioned or described in the specification shall not be construed as regarding any unclaimed component, step, or limitation to be essential in practicing the claimed subject matter.

Unless expressly or implicitly indicated otherwise, throughout the description and the appended claims, the terms "comprise", "comprising", "comprised of" and the like are to be construed in an inclusive sense as opposed to an exclusive or exhaustive sense, and are equivalent to the phrase, "including but not limited to". Each embodiment disclosed herein can comprise, consist essentially of, or consist of its particular stated element, step, ingredient, or limitation. As used herein, the transition terms "comprise", "comprises", "comprising", "include", "includes", "including", "is", "has", "having" or the like means "includes, but is not limited to, and allows for the inclusion of unspecified elements, steps, ingredients, or limitations, even in major amounts". The transitional phrase "consisting of" excludes any element, step, ingredient, or limitation not specified. The transition phrase "consisting essentially of" shall limit the scope of the embodiment to the specified elements, steps, ingredients, or limitations and to those that do not materially affect the embodiment. Throughout the written description, drawings and claims appended hereto, unless otherwise noted, it shall be recognized and understood that each embodiment of the described, illustrated and claimed subject matter may comprise, consist essentially of, or consist of any component, element or combination of components or elements set forth herein.

Unless otherwise noted using precise or limiting terminology, all numbers which express quantities of ingredients throughout the specification and claims are to be understood as being approximations of the numerical value cited to express the quantities of those ingredients. As used throughout the specification and claims, the term "about" has the meaning reasonably ascribed to it by a person skilled in the art when used in conjunction with a stated numerical value or range, i.e., denoting from the exact stated value or range to somewhat more or somewhat less than the stated value or range, from a deviation of from 0% with respect to the stated value or range to up to and including 20% of the stated value or range in either direction.

Various illustrative embodiments of the disclosure are described herein. Variations on the described illustrative embodiments may become apparent to those of ordinary skill in the art in reading the specification, drawings and claims of the disclosure. Accordingly, the disclosure encompassed by the specification, claims and drawings includes all modifications and equivalents of the subject matter recited in the claims as permitted by applicable law. Additionally, any combination of the elements in all possible variations thereof is encompassed by the subject matter of the disclosure unless otherwise indicated herein.

The term "or combinations thereof as used herein refers to all permutations and combinations of the listed items preceding the term. For example, "A, B, C, or combinations thereof is intended to include at least one of A, B, C, AB, AC, BC, or ABC, and if order is important in a particular context, also BA, CA, CB, CBA, BCA, ACB, BAC, or CAB. Continuing with this example, expressly included are combinations that contain repeats of one or more item or term, such as BB, AAA, AB, BBC, AAABCCCC, CBBAAA, CABABB, and so forth.

The skilled artisan will understand that typically there is no limit on the number of items or terms in any combination, unless otherwise apparent from the context.

Although the process-flow diagrams show a specific order of executing the process steps, the order of executing the steps may be changed relative to the order shown in certain embodiments. Also, two or more blocks shown in succession may be executed concurrently or with partial concurrence in some embodiments. Certain steps may also be omitted from the process-flow diagrams for the sake of brevity. In some embodiments, some or all the process steps shown in the process-flow diagrams can be combined into a single process.

Referring initially to FIGS. 1-4 of the drawings, an illustrative embodiment of the firearm recoil attenuating devices, hereinafter device, is generally indicated by reference number 1. As illustrated in FIG. 1, in typical application, which will be hereinafter described, the device 1 supports and anchors a firearm 40 to attenuate a recoil force 14 from the firearm 40 upon firing. The device 1 includes a firearm support base 2. As particularly illustrated in FIGS. 2-4, the firearm support base 2 may be generally rectangular in shape with a lower base portion 3 (FIG. 3); an upper base portion 4; and a front base portion 5, a rear base portion 6 and side base portions 7 extending between the lower base portion 3 and the upper base portion 4. An inner base wall 8 (FIG. 4) may extend between the lower base portion 3 and the upper base portion 4 in generally parallel and spaced-apart relationship to the rear base portion 5 and the side base portions 7. In some embodiments, the inner base wall 8 may include a pair of elongated, parallel, spaced-apart inner base wall side portions 8*a* and an inner base wall front portion 8*b* which extends between the inner base wall side portions 8*a*. The inner base wall side portions 8*a* of the inner base wall 8 may be disposed in parallel, spaced-apart relationship to the front base portion 5 of the firearm support base 2. The inner base wall front portion 8*b* of the inner base wall 8 may be disposed in parallel, spaced-apart relationship to the front base portion 5 of the firearm support base 2 and in perpendicular relationship to the inner base wall side portions 8*a*. An attenuating strap channel 16 may be formed by and between the inner base wall front portion 8*b* of the inner base wall 8 and the front base portion 5 and by and between the inner base wall side portions 8*a* of the inner base wall 8 and the side base portions 7, respectively, for purposes which will be hereinafter described.

A base interior 10 (FIG. 4) may be formed by and between the lower base portion 3, the upper base portion 4, the rear base portion 6 and the inner base wall 8. A filler material 12 may substantially fill the volume of the base interior 10. The filler material 12 may include sand, gravel, pebbles, beads and/or other particulate material. The filler material 12 may have a recoil-absorbing portion 13 at the front base portion 5 of the firearm support base 2. The inner base wall 8 of the firearm support base 2 may be disposed adjacent to the recoil-absorbing portion 13 of the filler material 12.

Figure 2:
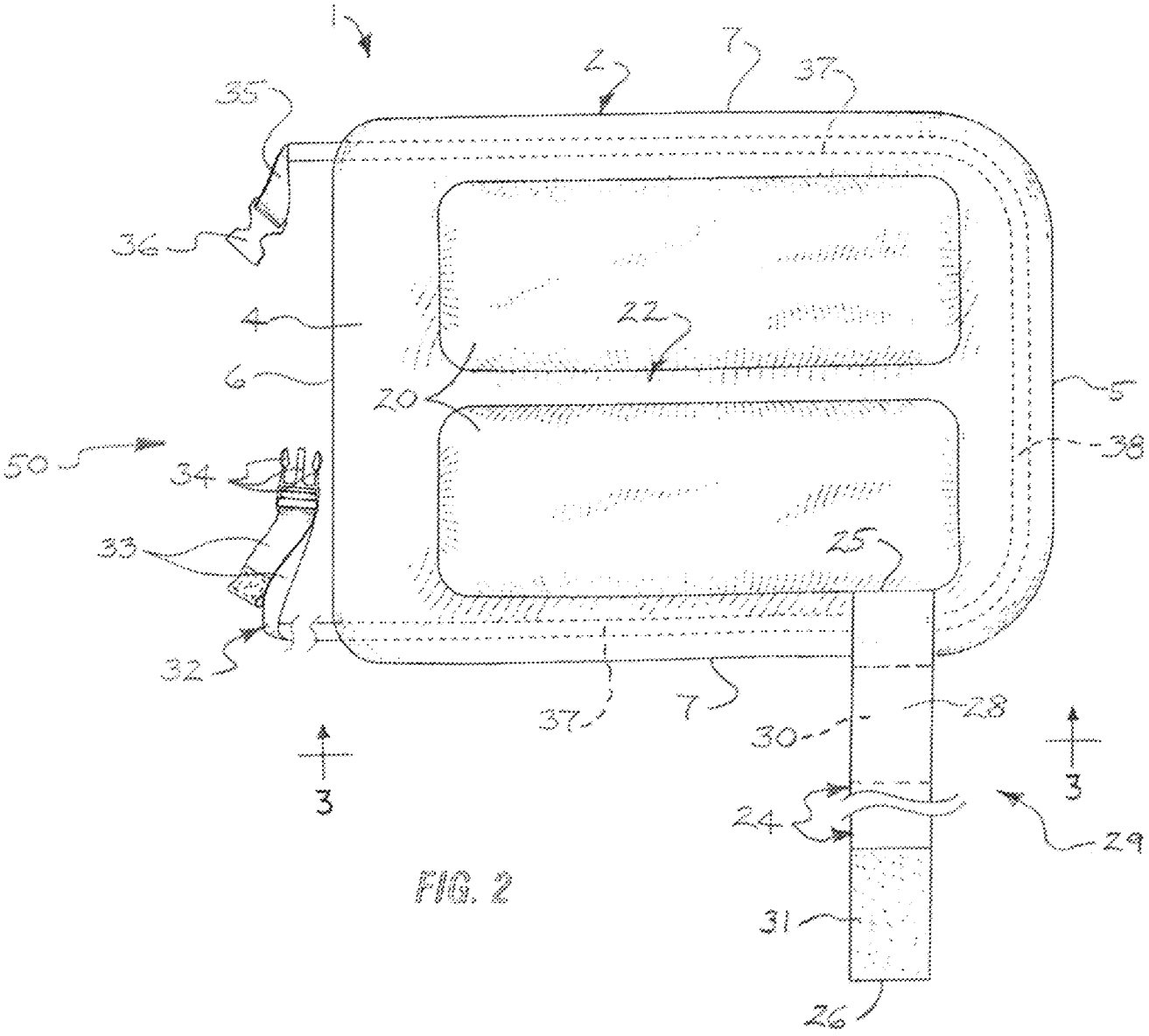
FIG. 2 is a top view, partially in section, of the illustrative firearm recoil attenuating device illustrated in FIG. 1.
Figure 3:
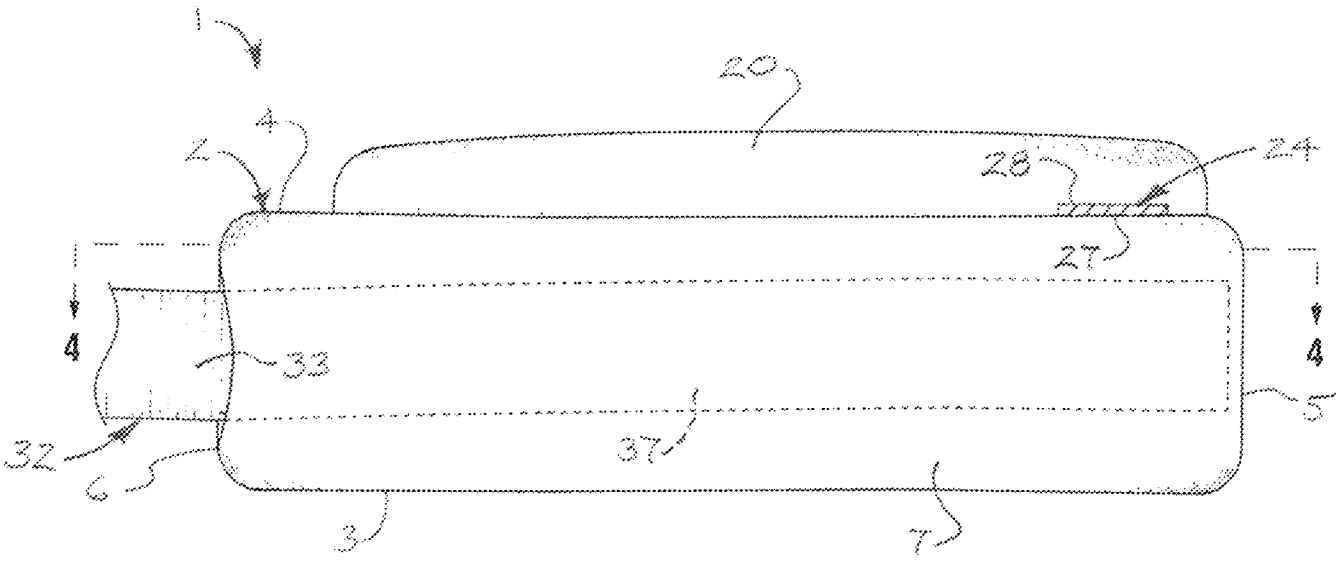
FIG. 3 is a side view, taken along viewing lines 3-3 in FIG. 2, of the illustrative firearm recoil attenuating device.
Figure 4:
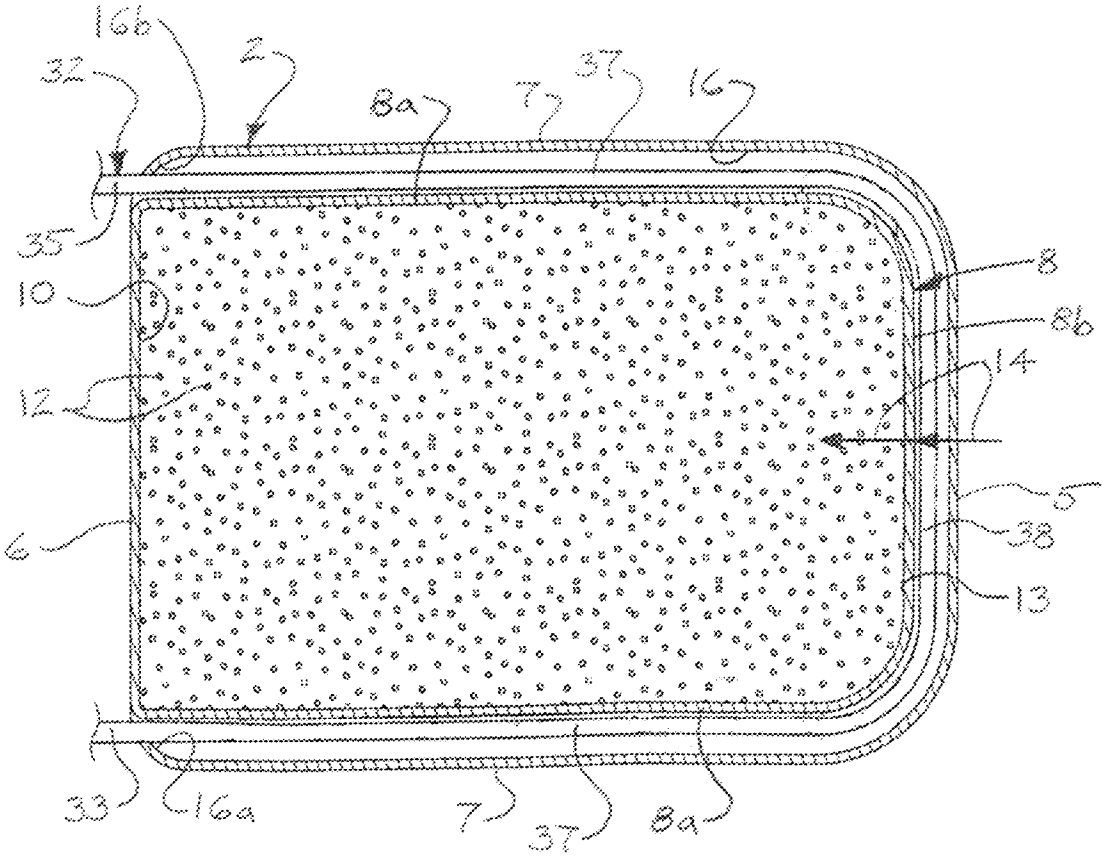
FIG. 4 is a sectional view, taken along section lines 4-4 in FIG. 3, of the illustrative firearm recoil attenuating device.

As illustrated in FIGS. 2 and 3, a pair of generally elongated, parallel, spaced-apart rifle stabilizing protrusions 20 may extend from the upper base portion 4 of the firearm support base 2. Each of the rifle stabilizing protrusions 20 may be substantially filled with the filler material 12 (FIG. 4). As illustrated in FIG. 2, an elongated firearm seat 22 may extend between the rifle stabilizing protrusions 20 for purposes which will be hereinafter described. The lower base portion 3, the upper base portion 4, the front base portion 5, the rear base portion 6, the inner base wall 8 and the rifle stabilizing protrusions 20 of the firearm support base 2 may be fabricated of canvas, burlap and/or other durable fabric material.

As illustrated in FIG. 4, a recoil attenuating strap 32 may extend through the attenuating strap channel 16 in the firearm support base 2. The recoil attenuating strap 32 may include nylon and/or other suitable material and may have a pair of side strap segments 37 which extend between the respective side base portions 7 and the inner base wall 8 and a rear strap segment 38 which is continuous with the side strap segments 37 and extends between the front base portion 5 and the inner base wall 8. A first attenuating strap fastening portion 33 of the recoil attenuating strap 32 may extend from the attenuating strap channel 16 through a first strap opening 16*a* in the rear base portion 6 on a first side of the firearm support base 2. A second attenuating strap fastening portion 35 of the recoil attenuating strap 32 may extend from the attenuating strap channel 16 through a second strap opening 16*b* in the rear base portion 6 on a second side of the firearm support base 2. As illustrated in FIG. 2, an attenuating strap fastening mechanism 50 may be provided on the recoil attenuating strap 32 to facilitate selective fastening and unfastening of the recoil attenuating strap 32. In some embodiments, the attenuating strap fastening mechanism 50 may include a conventional buckle-type quick disconnect connector known by those skilled in the art. Accordingly, the attenuating strap fastening mechanism 50 may include an attenuating strap tab 34 on the first attenuating strap fastening portion 33 and an attenuating strap buckle 36 on the second attenuating strap fastening portion 35 of the recoil attenuating strap 32. The attenuating strap tab 34 may be detachably inserted in the companion attenuating strap buckle 36 to fasten the recoil attenuating strap 32 to the firearm 40 (FIG. 1) and anchor the firearm 40 to the firearm support base 2 of the device 1, as will be hereinafter described. In some embodiments, the attenuating strap tab 34 may be adjustable in position along the first attenuating strap fastening portion 33, as illustrated, to selectively adjust the length of the recoil attenuating strap 32.

As illustrated in FIGS. 1-3, a firearm attachment strap 24 may be provided on the firearm support base 2 to additionally fasten the firearm 40 to the firearm support base 2. The firearm attachment strap 24 may include nylon and/or other suitable material. As illustrated in FIG. 2, the firearm attachment strap 24 may have a proximal strap end 25 and a distal strap end 26. The proximal strap end 25 may be attached to the firearm support base 2 generally at or adjacent to the front base portion 5. In some embodiments, the proximal strap end 25 may be sewn and/or otherwise attached to an exterior side of one of the rifle stabilizing protrusions 20 on the firearm support base 2 according to the knowledge of those skilled in the art. An attachment strap fastening mechanism 29 may be provided on the firearm attachment strap 24. The attachment strap fastening mechanism 29 may include a proximal strap fastener 30 which is provided on a first strap surface 27 (FIG. 3) generally adjacent to the proximal strap end 25 and a distal strap fastener 31 which is provided on a second strap surface 28 (FIG. 3) generally adjacent to the distal strap end 26 of the firearm attachment strap 24. In some embodiments, the proximal strap fastener 30 and the distal strap fastener 31 may include standard or conventional hook and loop fasteners known by those skilled in the art. In alternative embodiments, the proximal strap fastener 30 and the distal strap fastener 31 may include alternative fastening devices known by those skilled in the art.

As illustrated in FIG. 1, in typical application, the firearm support base 2 of the device 1 may be placed on a flat support surface (not illustrated). The firearm 40 may be placed and anchored on the firearm support base 2. The firearm 40 may have a conventional rifle design with a firearm receiver 41, a firearm stock 42 and a firearm barrel 43 extending from the firearm receiver 41 and a firearm scope 44 on the firearm receiver 41. A front scope mount 45 and a rear scope mount 46 may attach the firearm scope 44 to the firearm receiver 41.

The firearm receiver 41 of the firearm 40 may be inserted in the firearm seat 22 (FIG. 2) between the rifle stabilizing protrusions 20 on the firearm support base 2. The firearm 40 may be fastened to the firearm support base 2 by extending the firearm attachment strap 24 around the firearm barrel 43 and the firearm support base 2 and attaching the distal strap fastener 31 to the proximal strap fastener 30 (FIG. 2) of the attachment strap fastening mechanism 29 on the firearm attachment strap 24. The recoil attenuating strap 32 may be looped or extended around the front scope mount 45, as illustrated, or alternatively, around the rear scope mount 46 and the attenuating strap fastening mechanism 50 fastened. The recoil attenuating strap 32 may be tightened, as desired, typically by sliding the attenuating strap tab 34 (FIG. 2) along the first attenuating strap fastening portion 33 of the recoil attenuating strap 32.

A shooter (not illustrated) may aim and shoot the firearm 40 at a target. As it fires, the firearm 40 may recoil backwards and the front scope mount 45 may transmit a rearward recoil force 14 (FIG. 1) from the firearm 40 against the recoil attenuating strap 32. As illustrated in FIG. 4, the rear strap segment 38 of the recoil attenuating strap 32 may transmit the recoil force 14 against the inner base wall front portion 8*b* of the inner base wall 8, which may in turn transmit the recoil force 14 against the recoil-absorbing portion 13 of the filler material 12 in the base interior 10 of the firearm support base 2. Thus, the filler material 12 may absorb the recoil force 14 from the firearm 40, eliminating or substantially reducing the impact of the recoil force 14 which would otherwise be applied to the shoulder of the shooter. The firearm 40 can be selectively detached and removed from the firearm support base 2 after unfastening the firearm attachment strap 24 at the attachment strap fastening 29 and the recoil attenuating strap 32 at the attenuating strap fastening mechanism 50.

Figure 5:
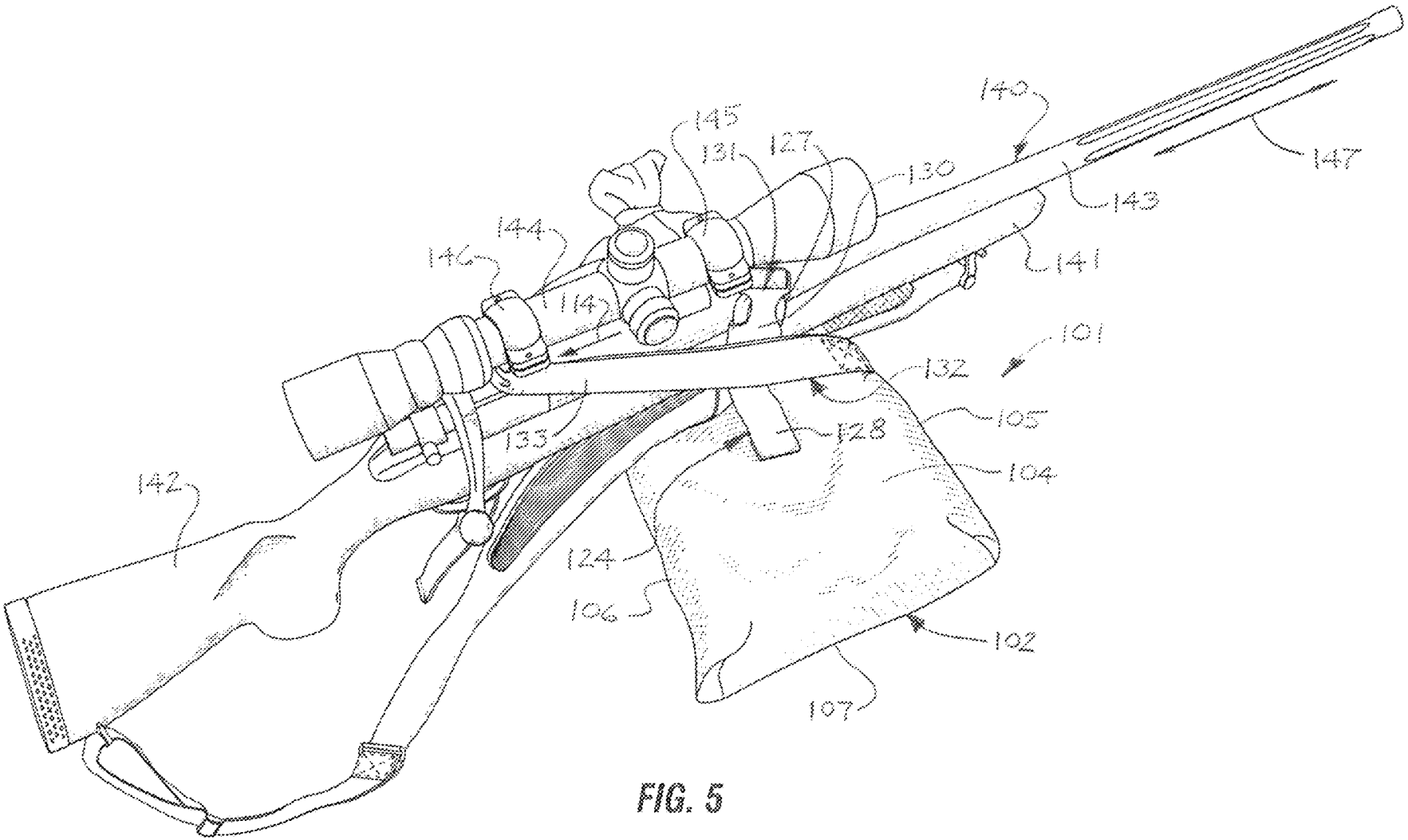
FIG. 5 is a perspective view of an alternative illustrative embodiment of the firearm recoil attenuating devices, with a firearm anchored to the device in typical application of the device.
Figure 6:
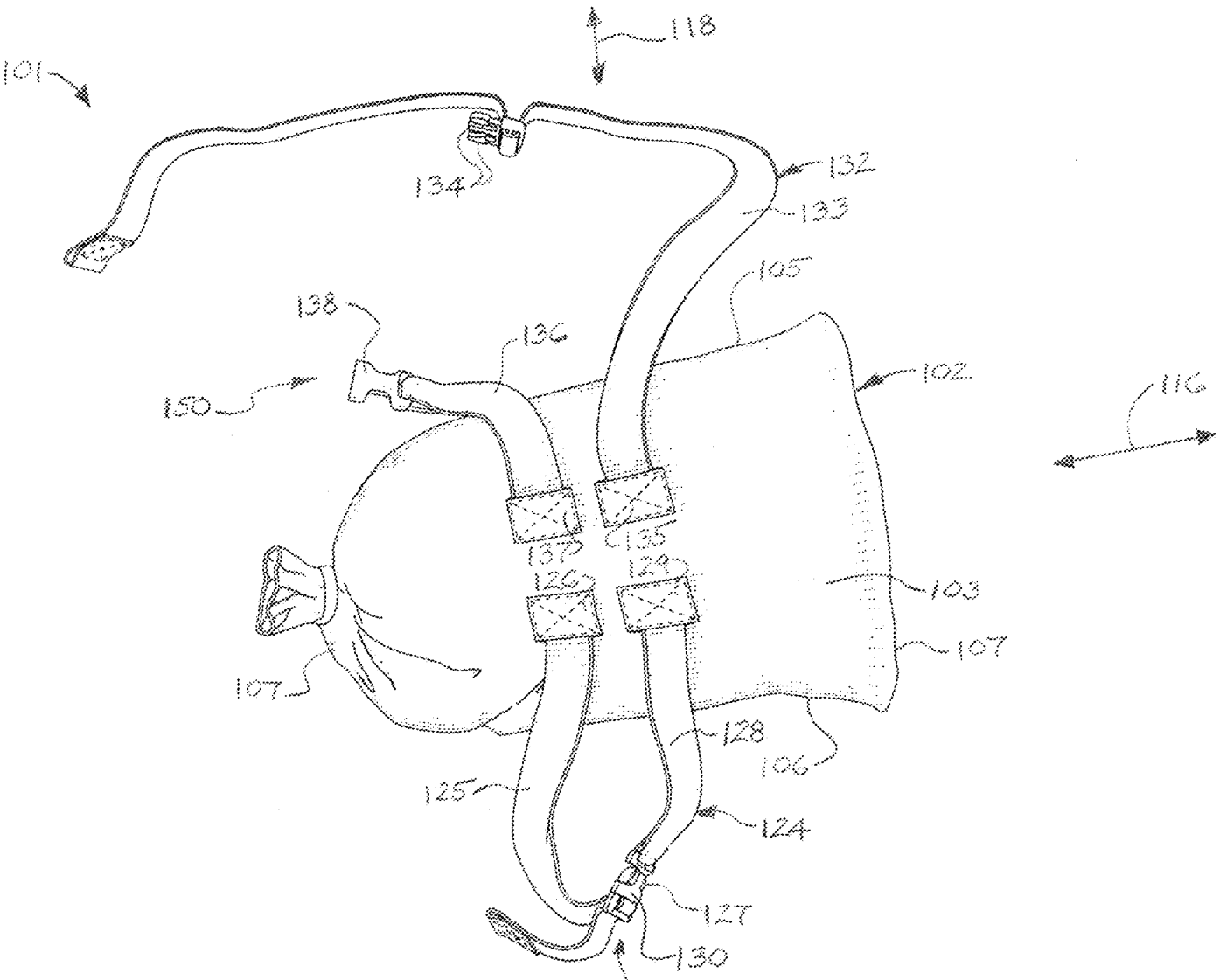
FIG. 6 is a bottom perspective view of the illustrative firearm recoil attenuating device illustrated in FIG. 5, with the firearm (not illustrated) removed from the device.
Figure 7:
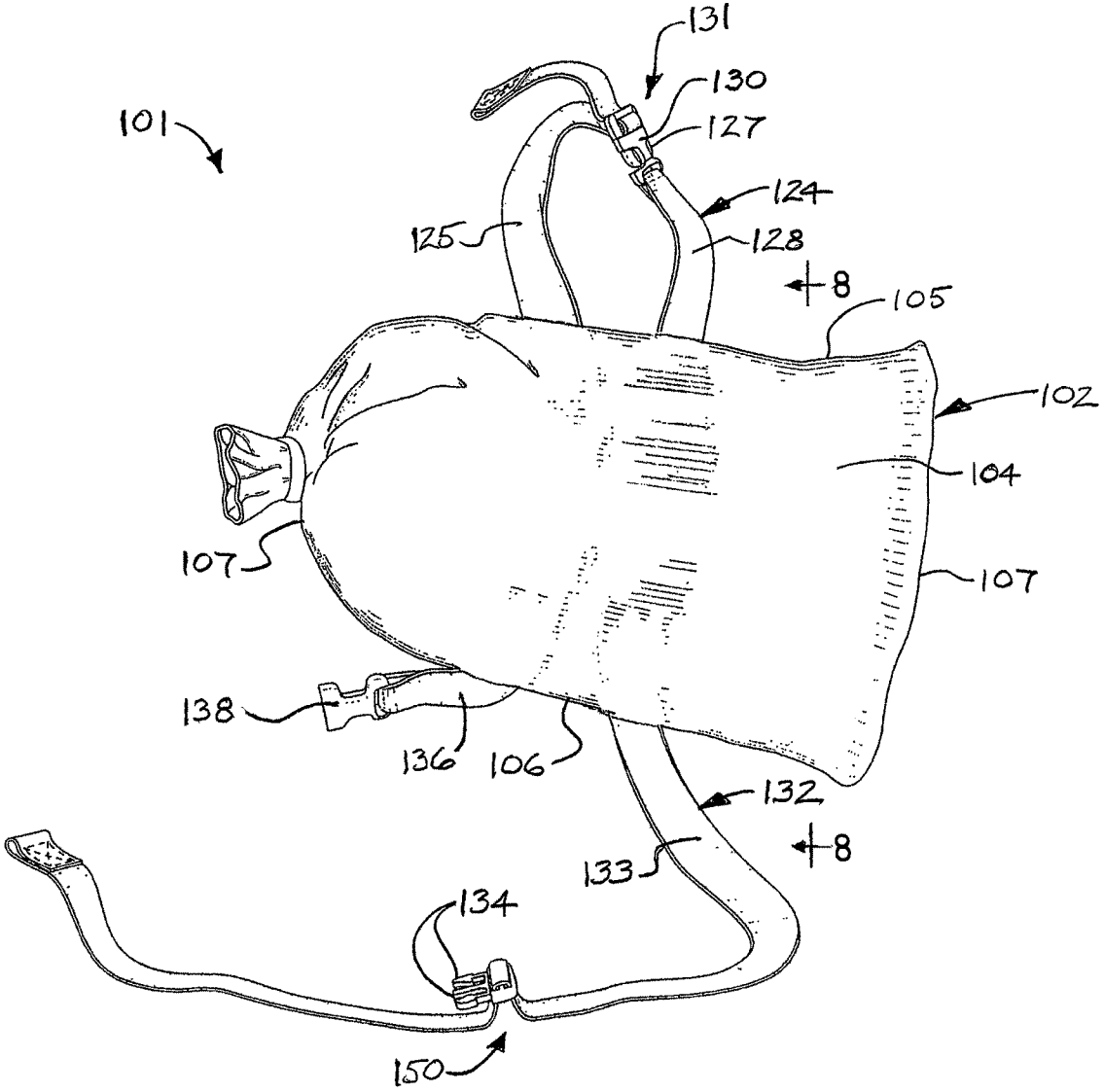
FIG. 7 is a top view of the illustrative firearm recoil attenuating device illustrated in FIG. 5, with the firearm (not illustrated) removed from the device.
Figure 8:
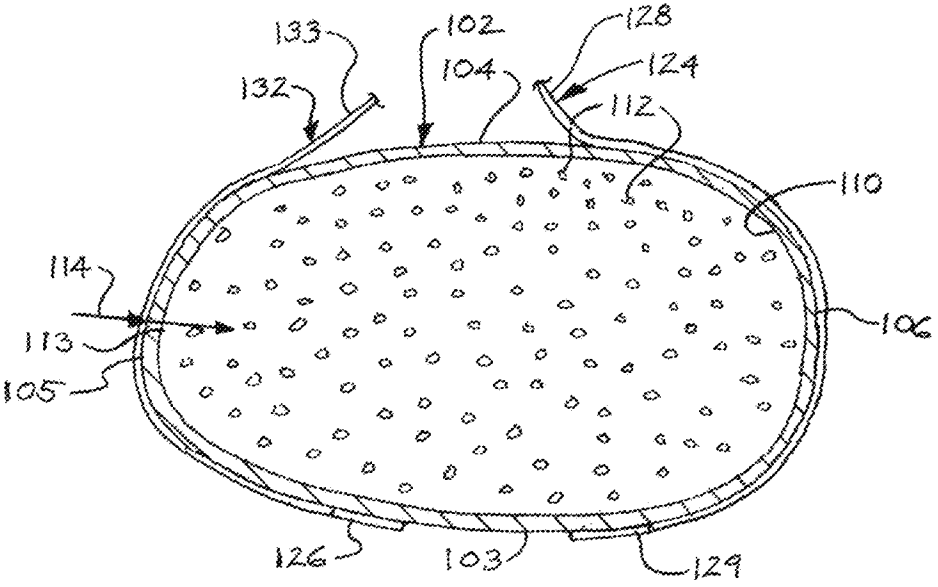
FIG. 8 is a cross-sectional view, taken along section lines 8-8 in FIG. 7.
Figure 9:
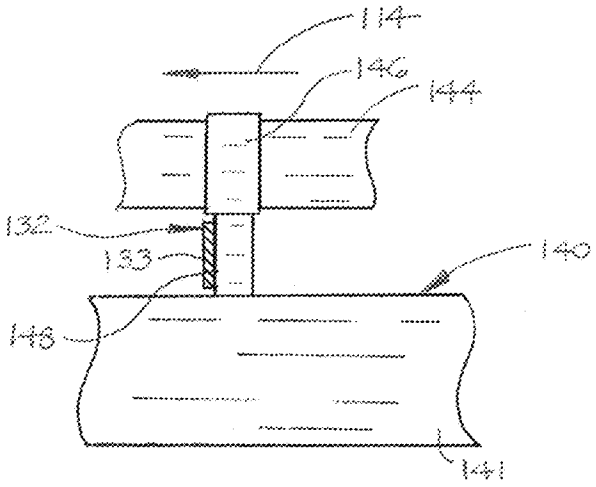
FIG. 9 is an enlarged sectioned side view of the firearm, more particularly illustrating typical engagement of the recoil attenuating strap against a rearwardly facing recoil surface on the firearm in typical application of the firearm recoil attenuating device.

Referring next to FIGS. 5-9 of the drawings, an alternative illustrative embodiment of the firearm recoil attenuating device is generally indicated by reference number 101. The device 101 may include a firearm support base 102. As illustrated in FIGS. 7 and 8, the firearm support base 102 may have a lower base portion 103 (FIG. 8), an upper base portion 104 and a front base portion 105 (FIG. 7), a rear base portion 106 and side base portions 107 extending between the lower base portion 103 and the upper base portion 104. The firearm support base 102 may be elongated with an elongated transverse support base axis 116 (FIG. 6) which bisects or extends through the side base portions 107 and is parallel to the front base portion 105 and the rear base portion 106. The transverse support base axis 116 may bisect the firearm support base 102 into equal front and rear longitudinal halves. The firearm support base 102 may have a firearm orientation axis 118 which bisects or extends through the front base portion 105 and the rear base portion 106 and is perpendicular to the transverse support base axis 116. The firearm orientation axis 118 may bisect the firearm support base 102 into equal left and right transverse halves. The firearm support base 102 may have a base interior 110 (FIG. 8). The base interior 110 may be substantially filled with a filler material 112 which may include sand, gravel, pebbles, beads and/or other particulate material. The lower base portion 103, the upper base portion 104, the front base portion 105, the rear base portion 106 and the side base portions 107 may be fabricated of canvas, burlap and/or other durable fabric material. In some embodiments, the firearm support base 102 may include a bag or the like which is substantially filled with the filler material 112 and tied or otherwise closed and secured at one of the side base portions 107, as illustrated in FIG. 7. For example and without limitation, in some embodiments, the firearm support base 102 may include a sandbag. As illustrated in FIG. 8, the filler material 112 may have a recoil-absorbing portion 113 at the front base portion 105 of the firearm support base 102. The front base portion 105 of the firearm support base 102 may engage the recoil-absorbing portion 113 of the filler material 112.

A firearm attachment strap 124 may be provided on the firearm support base 102 of the device 101. In some embodiments, the firearm attachment strap 124 may be attached to the lower base portion 103 of the firearm support base 102 according to the knowledge of those skilled in the art. As illustrated in FIG. 6, the firearm attachment strap 124 may include a first attachment strap fastening portion 125 and a second strap fastening portion 128. The first attachment strap fastening portion 125 and the second attachment strap fastening portion 128 may be attached to the lower base portion 103 via a first attachment strap webbing 126 and a second attachment strap webbing 129, respectively. As illustrated in FIG. 6, the first attachment strap webbing 126 and the second attachment strap webbing 129 may be disposed in spaced-apart relationship to each other in parallel relationship to and on the rear base portion 106 side of the transverse support base axis 116 and on opposite sides of the firearm orientation axis 118. As illustrated in FIGS. 6 and 7, the first attachment strap fastening portion 125 and the second attachment strap fastening portion 128 of the firearm attachment strap 124 may extend beyond the rear base portion 106 of the firearm support base 102. The first attachment strap fastening portion 125 and the second attachment strap fastening portion 128 of the firearm attachment strap 124 may have longitudinal axes which extend in generally transverse relationship to the transverse support base axis 116 which bisects the firearm support base 102 into equal left and right longitudinal halves.

An attachment strap fastening mechanism 131 may be provided on the firearm attachment strap 124 to facilitate detachable fastening of the first attachment strap fastening portion 125 and the second attachment strap fastening portion 128 to each other and securing of the firearm 140 (FIG. 5) on the firearm support base 102. In some embodiments, the attachment strap fastening mechanism 131 may include an attachment strap tab 127 on the first attachment strap fastening portion 125 and a companion attachment strap buckle 130 on the second attachment strap fastening portion 128. The attachment strap tab 127 may be mounted for selective adjustment in position along the first attachment strap fastening portion 125 according to the knowledge of those skilled in the art to selectively vary the length of the firearm attachment strap 124. In other embodiments, the attachment strap fastening mechanism 131 may include alternative strap fastening techniques or devices known by those skilled in the art. Nonlimiting examples of strap fastening techniques or devices which may be suitable for the purpose include but are not limited to buckles, hooks and opening fasteners, hook and loop fasteners, snaps, buttons, magnets, clips, clamps, and combinations thereof.

A recoil attenuating strap 132 may be provided on the firearm support base 102 of the device 101. In some embodiments, the recoil attenuating strap 132 may be attached to the lower base portion 103 of the firearm support base 102 according to the knowledge of those skilled in the art. The recoil attenuating strap 132 may include a first attenuating strap fastening portion 133 and a second attenuating strap fastening portion 136. The first attenuating strap fastening portion 133 and the second attenuating strap fastening portion 136 may be attached to the lower base portion 103 in adjacent relationship to each other via a first attenuating strap webbing 135 and a second attenuating strap webbing 137, respectively. As illustrated in FIG. 6, the first attenuating strap webbing 135 and the second attenuating strap webbing 137 may be disposed in spaced-apart relationship to each other and in parallel relationship to and on the front base portion 105 side of the transverse support base axis 116 and on opposite sides of the firearm orientation axis 118. As illustrated in FIGS. 6 and 7, the first attenuating strap fastening portion 133 and the second attenuating strap fastening portion 136 of the recoil attenuating strap 132 may extend beyond the front base portion 105 of the firearm support base 102. The first attenuating strap fastening portion 133 and the second attenuating strap fastening portion 136 of the firearm attenuating strap 132 may have longitudinal axes which extend in generally perpendicular or transverse relationship to the transverse support base axis 116 of the firearm support base 102.

An attenuating strap fastening mechanism 150 may be provided on the recoil attenuating strap 132 to facilitate detachable fastening of the first attenuating strap fastening portion 133 and the second attenuating strap fastening portion 136 to each other. In some embodiments, the attenuating strap fastening mechanism 150 may include an attenuating strap tab 134 on the first attenuating strap tab fastening 133 and a companion attenuating strap buckle 138 on the second attenuating strap fastening portion 136. The attenuating strap tab 134 may be mounted for selective adjustment in position along the first attenuating strap fastening portion 133 according to the knowledge of those skilled in the art to selectively vary the length of the recoil attenuating strap 132. In other embodiments, the attenuating strap fastening mechanism 150 may include alternative strap fastening techniques or devices known by those skilled in the art. Nonlimiting examples of strap fastening techniques or devices which may be suitable for the purpose include but are not limited to buckles, hooks and opening fasteners, hook and loop fasteners, snaps, buttons, magnets, clips, clamps, and combinations thereof.

As illustrated in FIG. 5, in typical application, the firearm support base 102 of the device 101 may be placed on a flat support surface (not illustrated). A firearm 140 may be placed and anchored on the firearm support base 102. The firearm 140 may have a conventional rifle design with a firearm receiver 141, a firearm stock 142 and a firearm barrel 143 extending from the firearm receiver 141 and a firearm scope 144 on the firearm receiver 141. A front scope mount 145 and a rear scope mount 146 may attach the firearm scope 144 to the firearm receiver 141.

The firearm receiver 141 of the firearm 140 may be placed on the upper base portion 104 of the firearm support base 102 with the longitudinal receiver axis 147 (FIG. 5) of the firearm receiver 141 oriented generally transverse to the front base portion 105 and the rear base portion 106 and generally parallel to the side base portions 107. The firearm 140 may be fastened to the firearm support base 102 by extending the firearm attachment strap 124 around the firearm barrel 143 and/or other component of the firearm 140, typically in front of the front scope mount 145, and fastening the attachment strap fastening mechanism 131 on the firearm attachment strap 124. The recoil attenuating strap 132 may be looped or extended, fastened and tightened around and in engagement with a rearwardly facing recoil surface 148 on the rear scope mount 146, as illustrated, or alternatively, on the front scope mount 145 and/or any other part or component of the firearm 140. The recoil surface 148 may include any surface or surfaces on any component or part of the firearm 140 which faces toward the firearm receiver stock 142 end of the firearm 140. Accordingly, in firing of the firearm 140, the recoil surface 148 may move rearwardly with the recoil force 114. As illustrated in FIGS. 5 and 8, as they extend along their course from the respective first attenuating strap webbing 135 and second attenuating strap webbing 137 to the point of engagement with the firearm 140, the respective first attenuating strap fastening portion 133 and second attenuating strap fastening portion 136 (FIG. 6) of the recoil attenuating strap 132 may engage the front base portion 105 of the firearm support base 102, at the recoil-absorbing portion 113 of the filler material 112.

As a shooter (not illustrated) aims and shoots the firearm 140 at a target, the firearm 140 may recoil backwards. Accordingly, the rear scope mount 146 may apply recoil force 114 (FIG. 5) from the firearm 140 rearwardly against the recoil attenuating strap 132. In turn, the recoil attenuating strap 132 may transmit the recoil force 114 against the front base portion 105 of the firearm support base 102, which may in turn transmit the recoil force 114 against the recoil absorbing portion 113 of the filler material 112 (FIG. 8) in the base interior 110 of the firearm support base 102. Thus, the filler material 112 may absorb the recoil force 114 from the firearm 140, eliminating or substantially reducing the impact of the recoil force 114 which would otherwise be applied to the shoulder of the shooter. The firearm 140 can be selectively detached and removed from the firearm support base 102 after unfastening the firearm attachment strap 124 at the attachment strap fastening mechanism 131 and the recoil attenuating strap 132 at the attenuating strap fastening mechanism 150.

While certain illustrative embodiments of the disclosure have been described above, it will be recognized and understood that various modifications can be made to the embodiments and the appended claims are intended to cover all such modifications which may fall within the spirit and scope of the disclosure.

What is claimed is:

1. A firearm recoil attenuating device for attenuating a recoil force from a firearm having a recoil surface, the firearm recoil attenuating device comprising:

an elongated firearm support base comprising:

a lower base portion, an upper base portion, a front base portion, a rear base portion, side base portions extending between the lower base portion and the upper base portion, and a base interior, the firearm support base having an elongated transverse support base axis bisecting the firearm support base into equal front and rear longitudinal halves and a firearm orientation axis perpendicular to the transverse support base axis and bisecting the firearm support base into equal left and right transverse halves;

a filler material in the base interior of the firearm support base, the filler material having a recoil-absorbing portion at the front base portion of the firearm support base, the front base portion of the firearm support base engaging the recoil-absorbing portion of the filler material; and a recoil attenuating strap attached to the lower base portion and engaging the front base portion of the firearm support base at the recoil-absorbing portion of the filler material, the recoil attenuating strap configured for engagement with the recoil surface on the firearm as the firearm rests on the upper base portion along or parallel to the firearm orientation axis to transmit the recoil force from the firearm to the recoil-absorbing portion of the filler material upon firing of the firearm.

2. The firearm recoil attenuating device of claim 1 wherein the filler material comprises sand, gravel, pebbles, or beads.

3. The firearm recoil attenuating device of claim 1 wherein the recoil attenuating strap comprises a first attenuating strap fastening portion and a second attenuating strap fastening portion attached to the lower base portion of the firearm support base in adjacent relationship to each other on opposite sides of the firearm orientation axis.

4. The firearm recoil attenuating device of claim 3 further comprising a first attenuating strap webbing and a second attenuating strap webbing attaching the first attenuating strap fastening portion and the second attenuating strap fastening portion, respectively, to the lower base portion of the firearm support base in spaced-apart relationship to each other and in parallel relationship to and on a front base portion side of the transverse support base axis.

5. The firearm recoil attenuating device of claim 1 further comprising a firearm attachment strap attached to the lower base portion of the firearm support base, the firearm attachment strap configured for attachment to the firearm to secure the firearm on the firearm support base.

6. The firearm recoil attenuating device of claim 5 wherein the firearm attachment strap comprises a first attachment strap fastening portion and a second strap fastening portion attached to the lower base portion in spaced-apart relationship to each other and in parallel relationship to and on a rear base portion side of the transverse support base axis and on opposite sides of the firearm orientation axis.

7. The firearm recoil attenuating device of claim 6 further comprising a first attachment strap webbing and a second attachment strap webbing attaching the first attachment strap fastening portion and the second attachment strap fastening portion, respectively, to the lower base portion of the firearm support base in spaced-apart relationship to each other and in parallel relationship to and on a rear base portion side of the transverse support base axis.

8. The firearm recoil attenuating device of claim 1 wherein the lower base portion, the upper base portion, the front base portion, the rear base portion and the side base portions of the firearm support base each comprises a fabric material.

9. A firearm recoil attenuating device for attenuating a recoil force from a firearm having a recoil surface, the firearm recoil attenuating device comprising:

an elongated firearm support base comprising:

a lower base portion, an upper base portion, a front base portion, a rear base portion, side base portions extending between the lower base portion and the upper base portion, and a base interior, the firearm support base having an elongated transverse support base axis bisecting the firearm support base into equal front and rear longitudinal halves and a firearm orientation axis perpendicular to the transverse support base axis and bisecting the firearm support base into equal left and right transverse halves;

a filler material in the base interior of the firearm support base, the filler material having a recoil-absorbing portion at the front base portion of the firearm support base, the front base portion of the firearm support base engaging the recoil-absorbing portion of the filler material; and a recoil attenuating strap attached to the lower base portion of the firearm support base proximate the recoil-absorbing portion of the filler material, the recoil attenuating strap configured for engagement with the recoil surface on the firearm as the firearm rests on the upper base portion along or parallel to the firearm orientation axis to transmit the recoil force from the firearm to the recoil-absorbing portion of the filler material upon firing of the firearm, the recoil attenuating strap comprising:

a first attenuating strap fastening portion and a second attenuating strap fastening portion attached to the lower base portion of the firearm support base in adjacent relationship to each other on opposite sides of the firearm orientation axis, the first attenuating strap fastening portion and the second attenuating strap fastening portion of the recoil attenuating strap extending beyond the front base portion of the firearm support base and having longitudinal axes extending in generally perpendicular or transverse relationship to the transverse support base axis of the firearm support base; and an attenuating strap fastening mechanism on the recoil attenuating strap, the attenuating strap fastening mechanism configured to releasably fasten the first attenuating strap fastening portion and the second attenuating strap fastening portion to each other.

10. The firearm recoil attenuating device of claim 9 wherein the filler material comprises sand, gravel, pebbles, or beads.

11. The firearm recoil attenuating device of claim 9 wherein the recoil attenuating strap comprises a first attenuating strap fastening portion and a second attenuating strap fastening portion attached to the lower base portion of the firearm support base in adjacent relationship to each other on opposite sides of the firearm orientation axis.

12. The firearm recoil attenuating device of claim 11 further comprising a first attenuating strap webbing and a second attenuating strap webbing attaching the first attenuating strap fastening portion and the second attenuating strap fastening portion, respectively, to the lower base portion of the firearm support base in spaced-apart relationship to each other and in parallel relationship to and on a front base portion side of the transverse support base axis.

13. The firearm recoil attenuating device of claim 9 further comprising a firearm attachment strap attached to the lower base portion of the firearm support base, the firearm attachment strap configured for attachment to the firearm to secure the firearm on the firearm support base.

14. The firearm recoil attenuating device of claim 13 wherein the firearm attachment strap comprises a first attachment strap fastening portion and a second strap fastening portion attached to the lower base portion in spaced-apart relationship to each other and in parallel relationship to and on a rear base portion side of the transverse support base axis and on opposite sides of the firearm orientation axis.

15. The firearm recoil attenuating device of claim 14 further comprising a first attachment strap webbing and a second attachment strap webbing attaching the first attachment strap fastening portion and the second attachment strap fastening portion, respectively, to the lower base portion of the firearm support base in spaced-apart relationship to each other and in parallel relationship to and on a rear base portion side of the transverse support base axis.

16. The firearm recoil attenuating device of claim 9 wherein the lower base portion, the upper base portion, the front base portion, the rear base portion and the side base portions of the firearm support base comprises a fabric material.

17. A firearm recoil attenuating device for attenuating a recoil force from a firearm having a recoil surface, the firearm recoil attenuating device comprising:

an elongated firearm support base comprising:

a lower base portion, an upper base portion, a front base portion, a rear base portion, side base portions extending between the lower base portion and the upper base portion, and a base interior, the firearm support base having an elongated transverse support base axis bisecting the firearm support base into equal front and rear longitudinal halves and a firearm orientation axis perpendicular to the transverse support base axis and bisecting the firearm support base into equal left and right transverse halves; and a filler material in the base interior of the firearm support base, the filler material having a recoil-absorbing portion at the front base portion of the firearm support base, the front base portion of the firearm support base engaging the recoil-absorbing portion of the filler material;

a recoil attenuating strap attached to the lower base portion of the firearm support base proximate the recoil-absorbing portion of the filler material, the recoil attenuating strap configured for engagement with the recoil surface on the firearm as the firearm rests on the upper base portion along or parallel to the firearm orientation axis to transmit the recoil force from the firearm to the recoil-absorbing portion of the filler material upon firing of the firearm, the recoil attenuating strap comprising:

a first attenuating strap fastening portion and a second attenuating strap fastening portion attached to the lower base portion of the firearm support base in adjacent relationship to each other on opposite sides of the firearm orientation axis, the first attenuating strap fastening portion and the second attenuating strap fastening portion of the recoil attenuating strap extending beyond the front base portion of the firearm support base and having longitudinal axes extending in generally perpendicular or transverse relationship to the transverse support base axis of the firearm support base; and an attenuating strap fastening mechanism on the recoil attenuating strap, the attenuating strap fastening mechanism configured to releasably fasten the first attenuating strap fastening portion and the second attenuating strap fastening portion to each other;

a firearm attachment strap attached to the lower base portion of the firearm support base, the firearm attachment strap configured for attachment to the firearm to secure the firearm on the firearm support base, the firearm attachment strap comprising:

a first attachment strap fastening portion and a second strap fastening portion attached to the lower base portion in spaced-apart relationship to each other and in parallel relationship to and on a rear base portion side of the transverse support base axis and on opposite sides of the firearm orientation axis, the first attachment strap fastening portion and the second attachment strap fastening portion of the firearm attachment strap extending beyond the rear base portion of the firearm support base and having longitudinal axes extending in generally transverse relationship to the transverse support base axis; and an attachment strap fastening mechanism on the firearm attachment strap, the attachment strap fastening mechanism configured to releasably fasten the first attachment strap fastening portion and the second attachment strap fastening portion to each other.

18. The firearm recoil attenuating device of claim 17 further comprising a first attenuating strap webbing and a second attenuating strap webbing attaching the first attenuating strap fastening portion and the second attenuating strap fastening portion, respectively, to the lower base portion of the firearm support base in spaced-apart relationship to each other and in parallel relationship to and on a front base portion side of the transverse support base axis; and a first attachment strap webbing and a second attachment strap webbing attaching the first attachment strap fastening portion and the second attachment strap fastening portion, respectively, to the lower base portion of the firearm support base in spaced-apart relationship to each other and in parallel relationship to and on a rear base portion side of the transverse support base axis.

19. The firearm recoil attenuating device of claim 18 wherein the filler material comprises sand, gravel, pebbles, or beads.

20. The firearm recoil attenuating device of claim 18 wherein the lower base portion, the upper base portion, the front base portion, the rear base portion and the side base portions of the firearm support base comprises a fabric material.

* * * * *